US006527823B2

(12) United States Patent
Moro

(10) Patent No.: US 6,527,823 B2
(45) Date of Patent: Mar. 4, 2003

(54) POWDER FOR DUST CORES AND DUST CORE

(75) Inventor: Hideharu Moro, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/891,685

(22) Filed: Jun. 26, 2001

(65) Prior Publication Data

US 2002/0014280 A1 Feb. 7, 2002

(30) Foreign Application Priority Data

Jun. 30, 2000 (JP) ..... 2000-198899

(51) Int. Cl.[7] ..... C22C 1/04; B22F 1/00
(52) U.S. Cl. ..... 75/246; 25/231; 25/252
(58) Field of Search ..... 75/252, 246, 231

(56) References Cited

U.S. PATENT DOCUMENTS 5,167,850 A * 12/1992 Shtarkman ..... 252/62.52
5,651,841 A * 7/1997 Moro et al. ..... 148/309
5,800,636 A * 9/1998 Tsukada et al. ..... 148/306
6,102,980 A * 8/2000 Endo et al. ..... 75/252
6,149,704 A * 11/2000 Moro et al. ..... 75/252

OTHER PUBLICATIONS

Patent Abstract of Japan, Publication No. 2000–030925, Date of Pub. of Appln. Jan. 1, 2000; Title: Dust Core and Its Manufacture: Appln. No. 10–199205, Filing Date: Jul. 14, 1998; Applicant: Daido Steel Co. Ltd; Inventor(s): Takanobu et al.

Patent Abstract of Japan, Publication No. 2000–030924, Date of Pub. of Appln. Jan. 28, 2000; Title: Soft Magnetic Alloy Powder Dust Core; Appln. No. 10–196110, Filing Date: Jul. 10, 1998; Applicant: Daido Steel Co Ltd.; Inventor(s): Takanobu et al.

Patent Abstract of Japan, Publication No. 11–195520, Date of Pub. of Appln. Jul. 21, 1999; Title: Dust Core, Ferromagnetic Powder Therefore and Production Thereof; Appln. No. 09–368032, Filing Date: Dec. 27, 1997; Applicant: TDK Corp, Inventor(s): Eiji et al.

Patent Abstract of Japan, Publication No. 10–335128, Date of Pub. of Appln. Dec. 18, 1998; Title: Ferromagnetic Powder for Dust Core, Dust Core and Its Manufacture; Appln. No. 10–092848; Filing Date: Mar. 20, 1998; Applicant: TDK Corp; Inventor(s): Shinji et al.

Patent Abstract of Japan, Publication No. 09–260126, Date of Pub. of Appln. Oct. 3, 1997; Title: Iron Powder for Dust Core, Dust Core and Manufacture Thereof; Appln. No. 08–247076, Filing Date: Aug. 29, 1996; Applicant: TDK Corp; Inventor: Gakuo et al.

Patent Abstract of Japan, Publication No. 09–170001, Date of Pub. Jun. 30, 1997; Title: Production of Soft Magnetic Iron Powder and Dust Core; Appln. No. 07–348110; Filing Date: Dec. 15, 1995; Applicant: TDK Corp; Inventor(s) Masataka et al.

Patent Abstract of Japan, Publication No. 08–045724, Date of Pub. of Appln. Feb. 16, 1996; Title: Dust Core; Appln. No. 06–195860; Applicant: TDK Corp, Inventor(s): Gakuo et al.

Patent Abstract of Japan, Publication No. 08–037107, Date of Pub. of Appln. Feb. 6, 1996; Title: Dust Core; Appln. No. 06–192207; Applicant TDK Corp, Inventor(s) Eiji et al.

Patent Abstract of Japan, Publication No. 07–254522, Date of Pub. of Appln. Oct. 3, 1995; Title: Dust Core and its Manufacture; Appln. No. 06–071693, Filing Date: Mar. 15, 1994; Applicant: TDK Corp; Inventor(s): Hideaki et al.

Patent Abstract of Japan, Publication No. 2000–049008, Date of Pub. of Appln. Feb. 18, 2000; Title: Ferromagnetic Powder for Dust Core Dust Core, and its Manufacture; Appln. No. 10–228668, Filing Date: Jul. 29, 1998, Applicant: TDK Corporation; Inventor(s): Eiji et al.

* cited by examiner

*Primary Examiner*—Ngoclan Mai
(74) *Attorney, Agent, or Firm*—Olson & Hierl, Ltd.

(57) ABSTRACT

To provide a powder for dust cores capable of improving magnetic properties such as magnetic permeability in a molded compacted powder magnetic core and mechanical properties such as size precision of the molded compacted powder magnetic core and radial crushing strength and, a dust core using the powder. A powder for a dust core contains a ferromagnetic powder, an insulating material containing silicone resin and/or phenol resin, and a lubricant, wherein the lubricant contains aluminum stearate, and a dust core using the powder for a dust core.

8 Claims, 4 Drawing Sheets

POWDER FOR DUST CORES AND DUST CORE

BACKGROUND OF THE INVENTION

1. Field of the Invention

The present invention relates to a powder for a dust core to be employed for a magnetic core of a transformer, an inductance and the like, a magnetic core for a motor, and other electronic parts and also relates to a dust core.

2.Prior Art

Recently, electric and electronic appliances have been miniaturized and along with the miniaturization, a dust core with a miniaturized size and a high efficiency has been required. As a magnetic material for a powder for dust core, a ferrite powder and a ferromagnetic powder are used. The ferromagnetic powder has a high saturation magnetic flux density as compared with the ferrite powder, so that the ferromagnetic powder is advantageous to enable a magnetic core to be miniaturized, however owing to a low electric resistance, it has a disadvantage that the eddy-current loss is increased. In order to lower the eddy-current loss as much as possible, an insulating film is formed on the surface of a ferromagnetic powder particle.

Other than that, in order to miniaturize the magnetic core, it is required that the saturation magnetic flux density is high and especially that a magnetic permeability in a high magnetic field of superimposed direct current is excellent and if the direct current superimposition high magnetic field property is excellent, the magnetic core can be miniaturized. That is since the operating magnetic field is defined as the electric current divided by the magnetic path length and therefore, if the magnetic core is miniaturized to shorten the magnetic path length, the operating magnetic field is transferred to the high magnetic field side. Even if the operating magnetic field is transferred to the high magnetic field side, a high inductance is obtained to make miniaturization possible, if the magnetic permeability in a high magnetic field of superimposed direct current is excellent and the magnetic permeability is high.

Further, other than the above, an inductor corresponding to a high current is required. In this case, also, if a magnetic core is excellent in the magnetic permeability in a high magnetic field of superimposed direct current, even in case that electric current is increased and the operation magnetic field is transferred to the high magnetic field side, the magnetic core can deal with the matter. Further, if the magnetic permeability in a high magnetic field of superimposed direct current is excellent and the magnetic permeability in a high magnetic field is not abruptly decreased, the number of turns of windings in, for example, an inductor can be increased and the inductance of the inductor is proportional to the square of the number of the turns of windings and therefore, further miniaturization is made possible.

However, even if dust core with which a magnetic core can be miniaturized is obtained, the size precision of the magnetic core becomes an important factor. In this case, particularly, it is required that the size alteration (hereinafter referred as to "spring back") in the case of separation from a mold after molding is slight. Especially, if the magnetic core has a complicated shape, owing to the different molding pressure in respective parts, the degrees of the spring back differ and it is made difficult that the magnetic core is molded with a size high precision.

Before now, in order to mold a magnetic core with a high size precision, a lubricant is added to a ferromagnetic powder. For example, JP-A-12-30925 and JP-A-12-30924 disclose compacted powder magnetic cores with a high magnetic permeability, a low core loss and high mechanical strength as well and produced by mixing an atomized powder of a soft magnetic alloy such as a Fe-based soft magnetic alloy powder, e.g. an atomized powder of a Fe—Si—Al based soft magnetic alloy having the average value of LL/LS ratio from 1.0 to 3.5, wherein LL denotes the length of the main axis and LS denotes the length of minor axis in the case of two-dimensional observation of the particle shape of the powder, with silicone resin, compacting and molding the resultant mixture, heating the compacted molded body at 600 to 900° C., and after that, immersing the obtained compacted powder molded body in liquid resin, and curing the resin.

JP-A-11-195520 discloses a compacted powder core with a high magnetic flux density, a low coercive force, a low core loss and a high mechanical strength and a ferromagnetic powder for the core, and a production method of the compacted core which is produced, according to the disclosure, by using a ferromagnetic powder for a compacted powder core composed of a ferromagnetic powder, titanium oxide sol and/or zirconium oxide sol, and phenol resin, pressurizing and molding the ferromagnetic powder, and then heating the molded body at 500 to 800° C.

JP-A-10-335128 discloses a compacted powder core using a ferromagnetic powder for a compacted powder core containing a ferromagnetic powder and 0.1 to 10% by volume of titanium oxide sol and/or zirconium oxide sol. Consequently, the disclosure actualizes a compacted powder core with a high magnetic flux density, a low coercive force, a low core loss and a high mechanical strength and a ferromagnetic powder for the core, and a production method of the compacted core.

JP-A-9-260126 proposes to actualize a compacted powder core having a high magnetic flux density, a low coercive force, and a low core loss, especially such excellent properties in a range of 50 to 10,000 Hz frequency and capable of replacing for a laminated silicon steel plate core in terms of intrinsic properties and discloses a compacted powder core containing 0.03 to 0.1% by weight of Si, 15 to 210 ppm of Ti, 300 to 2500 ppm of oxygen, and an iron powder with the particle size of 75 to 200 $\mu$m and obtained by mixing an iron powder with the particle size of 75 to 200 $\mu$m, silica sol in 0.015 to 0.15% by weight to the iron powder on the bases of solid matter, silicone resin in 0.05 to 0.5% by weight to the iron powder, and an organotitanium in 10 to 50% by weight to the silicone resin, hardening the powder mixture at 50 to 250° C., molding the powder, and then annealing the molded body at 550 to 650° C. in an inert gas atmosphere.

JP-A-9-170001 discloses a production method characterized as follows. A powder mixture of a soft magnetic iron powder, a heat resistant powder, an alkaline earth metal carbonate powder is heated and then the heat resistant powder and an alkaline earth metal oxide powder, which is a decomposition product of the alkaline earth metal carbonate powder, are separated from the resultant powder mixture. The powder mixture contains the alkaline earth metal carbonate powder in 0.5 to 5% by weight to the soft magnetic iron powder. The heating treatment is carried out in hydrogen/nitrogen mixture atmosphere or pure nitrogen atmosphere. Consequently, the patent proposes a compacted powder core with a high saturation magnetization and a low coercive force and possible to replace for a laminated silicon steel plate core and a soft magnetic iron powder to be used for producing the core at a low cost.

JP-A-8-45724 discloses a compacted powder core of a Fe—P alloy powder containing 0.5 to 1.5% by weight of P and a compacted powder core using an organotitanium together with silicone resin as a binder. Consequently, the patent provides a compacted powder core with a low coercive force, a low core loss, a high saturation magnetization, and improved mechanical strength as well.

JP-A-8-37107 discloses a compacted powder core which is a core produced by compacting a ferromagnetic powder and an insulating agent and then annealing the compacted powder, wherein the ferromagnetic powder is an approximately spherical ferromagnetic metal particle containing Fe, Al, and Si in order to provide an economical compacted powder core with a low core loss and a compacted powder core with a low core loss and high mechanical strength.

Further, JP-A-7-254522 discloses a production method comprising a primary mixing step of mixing a ferromagnetic powder and silicone resin, a primary heating step of heating a primary mixture obtained in the primary mixing step in non-oxidative atmosphere, a secondary mixing step of mixing silicone resin and the primary mixture, a secondary heating step of heating a secondary mixture obtained in the secondary mixing step at a temperature lower then the treatment temperature in the primary heating step, a molding step, and an annealing step in this order. Consequently, a compacted powder core produced by pressurizing and molding the ferromagnetic powder is provided with improved magnetic permeability and its frequency properties and increased mechanical strength as well.

Further, these patents disclose a stearic acid metal salt including aluminum stearate can be employed.

Further, JP-A-12-49008 discloses a ferromagnetic powder for dust cores containing at least one stearic acid metal salt selected from magnesium stearate, calcium stearate, strontium stearate, and barium stearate.

Any of the above described patents such as JP-A-12-30925 and the like provide a ferromagnetic powder for dust cores with magnetic properties such as a high saturation magnetic flux density, a low core loss, and a high magnetic permeability or the like. However, none of the patents discloses a ferromagnetic powder for dust cores with excellent mechanical properties such as capability to increase the strength of the molded body and to lower the spring back degree after separation from a mold.

SUMMARY OF THE INVENTION

The present invention therefore has a object to provide a powder for dust cores capable of improving magnetic properties such as magnetic permeability in a dust core and improving mechanical properties such as size precision of the molded dust core and radial crushing strength and to provide dust cores using the powder.

In order to achieve the above described object, a first aspect of the present invention provides a powder for dust cores containing a ferromagnetic powder, an insulating material containing silicone resin and/or phenol resin, and a lubricant, wherein the lubricant contains aluminum stearate.

A second aspect of the present invention provides the powder for dust cores of the first aspect, wherein the lubricant is aluminum stearate with the metal content of 4% by weight or more.

A third aspect of the present invention provides a dust core produced by mixing a ferromagnetic powder, an insulating material containing silicone resin and/or phenol resin, and a lubricant and molding the resultant mixture, wherein the lubricant contains aluminum stearate.

A fourth aspect of the present invention provides the dust core of the third aspect, wherein the lubricant is aluminum stearate with the metal content of 4% by weight or more.

DESCRIPTION OF THE PREFERRED EMBODIMENTS

Figure 1:
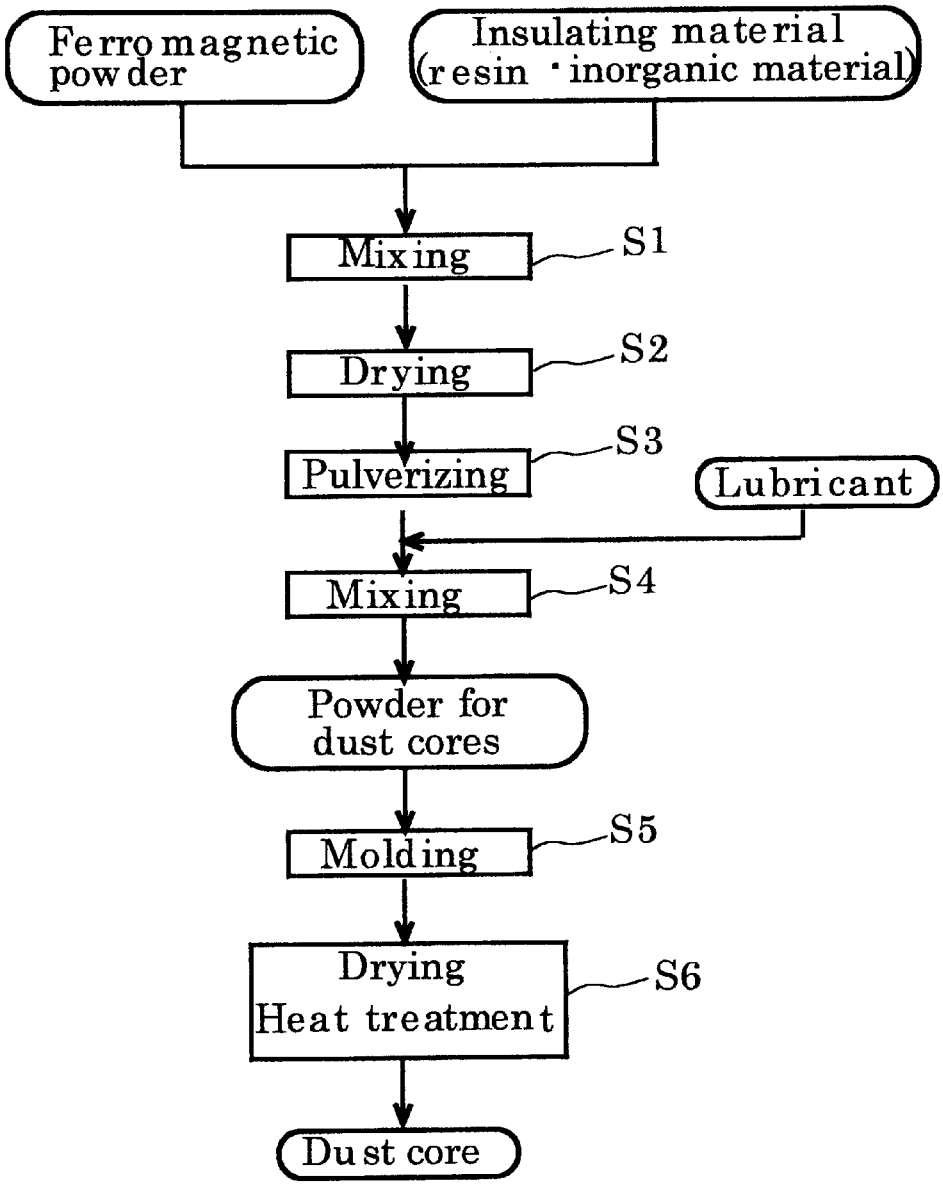
FIG. 1 shows materials contained in a powder for dust cores and a production process thereof according to the present invention.

Hereinafter, the embodiments of the present invention will be described in detail. FIG. 1 shows materials contained in a powder for dust cores and a dust core and a production process thereof according to the present invention.

The present invention is a powder containing a ferromagnetic powder as shown in FIG. 1. The ferromagnetic powder is not particularly restricted and usable are at least one ferromagnetic powder selected from soft magnetic materials such as Fe, Fe—Ni—Mo (Supermalloy), Fe—Ni (Permalloy), Fe—Si—Al (Sendust), Fe—Co, Fe—Si, Fe—P and the like. The average particle diameter of the ferromagnetic powder is 5 to 150 $\mu$m, preferably 10 to 100 $\mu$m. If the average particle size is 5 $\mu$m or smaller, the coercive force is too high and if 150 $\mu$m or larger, the eddy-current loss is too high.

Further, the shape of the ferromagnetic powder may be spherical or flat and is not particularly restricted. For example, in the case of a toroidal magnetic core and an E-type magnetic core having a rectangular leg of a winding of a conductor, transversely pushing molding to carry out molding by pressurizing in the perpendicular direction to the magnetic path direction at the time of using is possible and by the transversely pushing molding, the main face of a flat particle among the compacted powder magnetic core can be kept approximately parallel to the magnetic path, so that using the flat particle can result in further improvement of the magnetic permeability. As the flattening means, usable means may properly be selected from a ball mill, a rod mill, a vibration mill, an attrition mill and the like having rolling and shearing functions. The ratio of flattening is not particularly restricted, however it is preferable to have the aspect ratio of about 5 to 25.

Further, the surface of the ferromagnetic powder is preferable to be smooth. If the surface of the ferromagnetic powder is smooth, the filling ratio can be increased at the time of molding by applying pressure. Further, if the surface is uneven, the stress is concentrated upon the convex parts and strains are easy to be caused to deteriorate the magnetic characteristics such as magnetic permeability and further these parts receive pressure and the ferromagnetic powder particles are brought into contact with each other to result in dielectric breakdown and increase of eddy current loss.

Further, the present invention contains resin as an insulating material as shown in FIG. 1. Owing to that, the core loss is lowered by insulating the ferromagnetic powder particles and the resin functions as a binder to improve the mechanical strength of a dust core. As the resin, usable are styrene resin, acrylic resin, styrene/acrylic resin, ester resin, urethane resin, olefin resin such as polyethylene, phenol resin, carbonate resin, ketone resin, fluoro resin such as fluoromethacrylate and vinylidene fluoride, silicone resin, phenol resin and its modified products. Among the resins, two types of resins or more may be used together by a method of copolymerization, mixing or the like. Among them, silicone resin and phenol resin are especially preferable.

The silicone resin is resin having siloxane bonds and highly water-repellent and stable against environmental changes and therefore it is suitable for an insulating resin for a dust core. Further, owing to the silicone resin, bonding of the ferromagnetic powder is made dense and a powder for dust cores with a high strength can be obtained. The types of silicone resin are not specifically restricted and both of heat setting silicone resin and air setting silicone resin can be employed. Between them, if the air setting silicone resin is used, since it is no need to be heated at a high temperature, the resin has an advantage that the compacted powder magnetic core is easily produced. On the other hand, if the heat setting silicone resin is used, it is required to carry out heating at 200 to 400° C. In order to promote curing, heating in a range of 100 to 300° C. can be carried out even for the normal temperature curable silicone resin. Further, a condensation reaction type silicone resin cured by reaction can be used. The silicone resin is preferable to have the weight average molecular weight of 600 to 3300 and further preferable to have the weight average molecular weight of 800 to 2500. The lower the weight average molecular weight becomes, the higher the strength of the molded body is and powdering of the edge part of the molded body tends to be lowered. However, if the weight average molecular weight is less than 600, the decreasing amount of the resin is too large at the time of heating at a high temperature, so that the insulating property among the ferromagnetic powder particles in a dust core cannot be maintained.

Phenol resin is a resin synthesized by reaction of phenols and aldehydes and is economical and excellent in non-flammability and suitable for use as the insulating resin for a dust core. The phenol resin can be broadly classified into novolak type and resol type and both may be used and in the present invention, the resol type phenol resin is preferable. Among the resol type resins, those which contain N in form of tertiary amine are especially preferable since they have high heat resistance. On the other hand, in the case of using the novolak type resin, the strength of the molded body is lowered to make it difficult to handle in the process after molding. In the case of using the novolak type resin, molding under heating (such as a hot press) is preferable to be carried out. The temperature at the time of molding in this case is normally at about 150 to 400° C. Incidentally, preferable novolak type resin contains a cross-linking agent. The weight average molecular weight of the phenol resin is preferably 300 to 7000, more preferably 500 to 7000 and furthermore preferably 500 to 6000. The lower the weight average molecular weight is, the higher the strength of the molded body becomes and powdering in the edge parts of the molded body tends to be lowered. However, if the weight average molecular weight is less than 300, the decreasing amount of the resin is increased at the time of annealing at a high temperature, so that the insulating property among the ferromagnetic powder particles in a dust core can not be maintained.

The total content of the phenol resin and the silicone resin is preferably 1 to 30% by volume and more preferably 2 to 20% by volume to the ferromagnetic powder. If the resin amount is too small, the mechanical strength of the magnetic core is lowered and the insulating failure sometimes takes place. On the other hand, if the resin amount is too large, the ratio of the non-magnetic components in the compacted powder magnetic core is increased and the magnetic permeability and the magnetic flux density of the magnetic core are decreased.

Incidentally, the phenol resin and the silicone resin are preferable to be used solely, however they may be used in combination based on necessity and in that case, the mixing ratio is optional.

In the case that insulating resin and a ferromagnetic powder are mixed, solid or liquid resin may be made to be a solution to be mixed or liquid resin may directly be mixed. The viscosity of the liquid resin is preferably 10 to 10,000 mPa·s at 25° C. and more preferably 50 to 9,000 mPa·s. Too low or too high viscosity makes it difficult to form a uniform coating on the surface of the ferromagnetic powder. Further, in the case of mixing solid insulating resin, the insulating resin may be pulverized by a pulverizer to be a fine particle and then mixed. Consequently, the mixing property with the ferromagnetic powder is improved and a thin insulating resin coating film can be formed on the surface of the ferromagnetic powder.

As an insulating material of the present invention, an inorganic insulating material may be used in combination with the insulating resin as shown in FIG. 1. As the inorganic insulating material, usable are inorganic oxides such as silicon oxide (silica ($SiO_2$)), aluminum oxide (alumina ($Al_2O_3$)), titanium oxide (titania ($Ti_2$)), zirconium oxide (zirconia ($ZrO_2$)) and the like, inorganic carbides such as aluminum carbide (AlC), titanium carbide (TiC) and the like, inorganic nitrides such as aluminum nitride (AlN), titanium nitride (TiN) and the like and those surface-treated with a surface modifying agent, resin and the like. A silane coupling agent and a titanate coupling agent as the surface modifying agent are preferred for surface treatment to make the inorganic insulating materials hydrophobic.

Further, these inorganic insulating materials may be used while being dispersed even in a solvent in colloidal state. As the solvent, aqueous and non-aqueous ones are available, however in terms of compatibility with the insulating resin, non-aqueous solvent is preferable and more preferable are ethanol, butanol, toluene, benzene, xylene and the like.

The addition amount to the ferromagnetic powder on bases of solid matter is preferably 0.1 to 15.0% by volume and especially preferably 0.5 to 5.0% by volume. That is, if the addition amount of solid matter of silica, titania, zirconia and the like is too small, the insulation property among the ferromagnetic powder particles becomes insufficient and the eddy-current loss or the like is increased. If the addition amount is too large, the non-magnetic components in the compacted powder magnetic core is too much to deteriorate the magnetic characteristics such as magnetic permeability.

Further, the present invention contains a lubricant as shown in FIG. 1. As the lubricant, examples are low molecular weight hydrocarbons, fatty acids, and metal salts. Further, compounds such as molybdenum disulfide ($MoS_2$) are also included. Especially, as metal salts, fatty acid metal salts are preferable. As the fatty acids, preferable are stearic acid, palmitic acid, myristic acid, and oleic acid and the metals preferable are zinc, calcium, strontium, barium, and aluminum. Among these fatty acid metal salts, further preferable is aluminum strearate. Aluminum stearate includes three types; aluminum monostearate, aluminum distearate, and aluminum tristearate, and it is sufficient to contain at least one of them (hereinafter, they are called as aluminum stearate).

Aluminum stearate is used as a lubricant for resin, a dispersant of a coating material and an ink, a stabilizer for grease. If aluminum stearate is used for the compacted powder magnetic core, it is found that the spring back degrees is suppressed too low and the strength of the molded body is increased as compared with other stearic acid metal salts.

Figure 2:
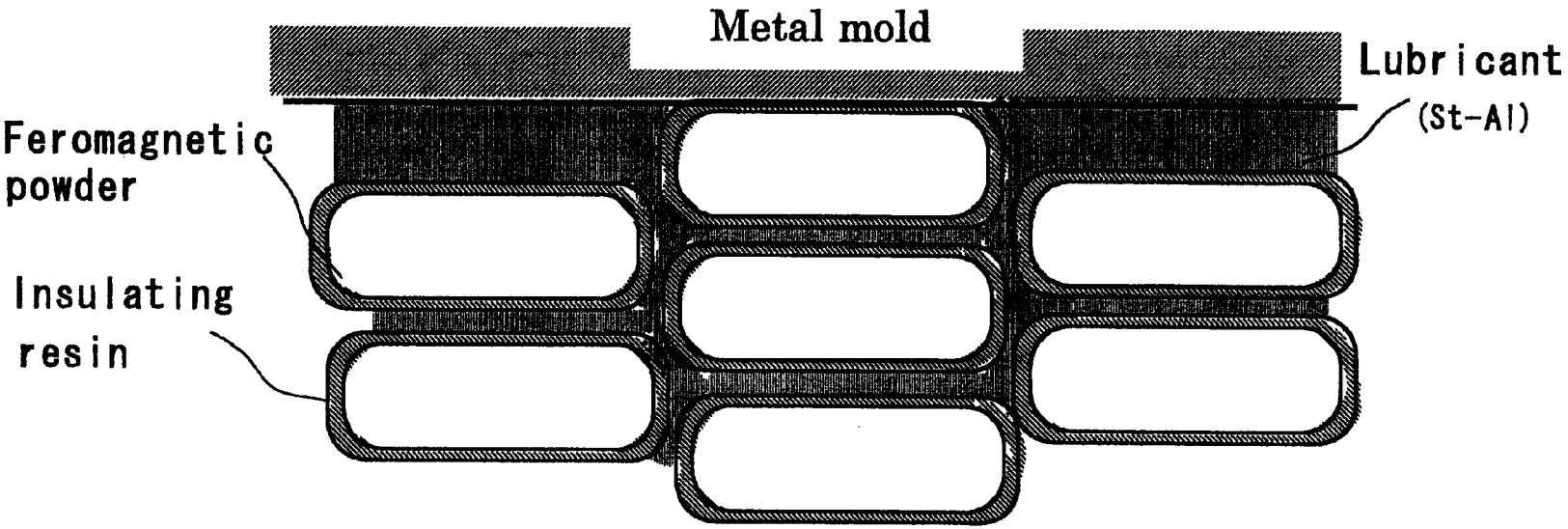
FIG. 2 is a diagram schematically showing the structure of the inside of the dust core using the powder for dust cores of the present invention.
Figure 3:
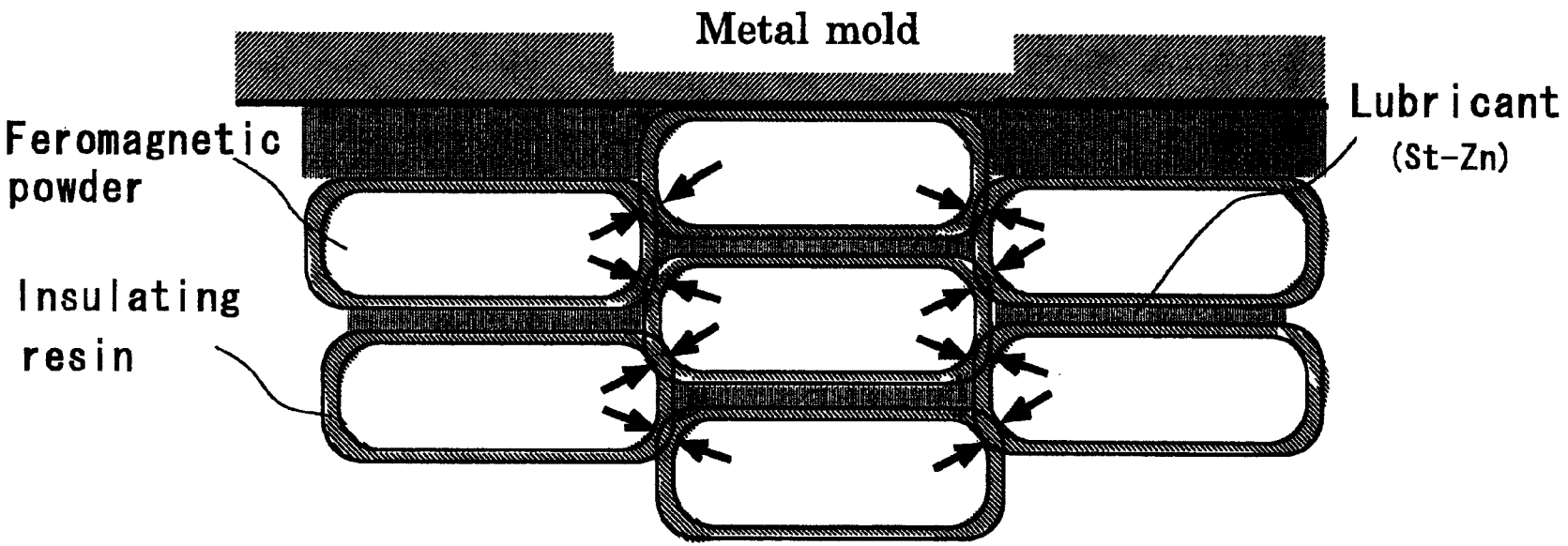
FIG. 3 is a diagram schematically showing the structure of the inside of a dust core using a conventional powder for a dust core.

FIG. 2 is a diagram schematically showing the structure of the inside of the compacted powder magnetic core using the powder for the compacted powder magnetic core of the present invention. FIG. 3 is a diagram schematically showing the structure of the inside of the compacted powder magnetic core using a conventional powder for a dust core.

Since a stearic acid metal salt is a salt, it has ionic bond with the metal, however it has low ionic property and inferior isolation property and thus has water-repellency and durability to environmental changes. Further, the stearic acid metal salts can be classified into a first group including zinc stearate, calcium stearate and the like with extremely low friction coefficient and a second group including aluminum stearate, iron stearate with high friction coefficient, for example, by pulling rubber bearing a weight on metal surface even coated with the stearic acid metal salts. Further, the effect of the stearic acid metal salts as a lubricant is derived from slippage property owing to the cleavage property in the end faces of the stearic acid metal salts. The cleavage property can be determined by simulation based on the flow out speed through a prescribed hole when a prescribed pressure is applied. In the second group, aluminum stearate has a smaller flow out speed than iron stearate and aluminum stearate is therefore found having lower cleavage property. Incidentally, in this case, the first group has extremely high flow out speed as compared with the second group and is found to have high cleavage property. However, those with a friction coefficient low to a certain extent and also low cleavage property remains as a thick film among the ferromagnetic powder particles as compared with those with high cleavage property remains as a thin coating among the ferromagnetic powder. Therefore, as shown in FIG. 2, aluminum stearate having a low friction coefficient and low cleavage property can prevent direct contact among ferromagnetic powder particles, and prevent strains remaining in the ferromagnetic powder to lower the spring back degree. In case of zinc stearate and the like as a conventional lubricant, as shown in FIG. 3, owing to high cleavage property, zinc stearate is fluidized and moves to parts where the pressure is low when receiving pressure and consequently, the ferromagnetic powder particles are brought into contact with each other and elastically and plastically deformed. Hence, strains remain and the spring back degree becomes high at the time of separation from a mold.

Further, as the metal content of aluminum stearate becomes high, the spring back degree becomes low and the strength of the molded body can be increased. Consequently, it is preferable for the metal content of aluminum stearate to be 4% by weight or higher. That is, if the metal of aluminum stearate is 4% by weight or lower, the amount of aluminum di- and tri-strearate increases and the structure of aluminum stearate is complicated and the friction coefficient is further increased and the cleavage property is lowered to make the aluminum stearate impossible to function as a lubricant On the other hand, if the metal content is 7.8% by weight or higher, independent metal Al, which is not bonded to stearic acid, exists to inhibit the function as a lubricant.

Further, the free fatty acid generated at the time of production of aluminum stearate is preferably suppressed at highest 30% by weight and further preferably 10% by weight or lower since it deteriorates the effect as a lubricant. That is, if the free fatty acid is increased, the friction coefficient is increased and the cleavage property is too low, so that the function of aluminum stearate as a lubricant is made invalid. As the free fatty acids, examples are stearic acid, palmitic acid, myristic acid, oleic acid and the like.

Further, the addition amount of aluminum stearate to the ferromagnetic powder is preferably 0.2 to 1.5% by weight and further preferable 0.3 to 1.0% by weight. If the addition amount of aluminum stearate is too small, the insulation among the ferromagnetic powder particles in the compacted powder magnetic core becomes insufficient and it takes place a trouble that the compacted powder magnetic core becomes difficult to pull out of a mold at the time of molding. If the addition amount of the lubricant is too large, the ratio of the non-magnetic components in the compacted powder magnetic core is increased and the magnetic permeability and the magnetic flux density of the magnetic core are decreased and that the strength of the molded body is lowered.

In this case; together with aluminum stearate, other stearic acid metal salts may be added as lubricants. At that time, it is preferable for other stearic acid metal salts to be within 30% by weight in the aluminum stearate. Because there is a proper range for the ferromagnetic powder in relation to the friction coefficient and the cleavage property.

Next, the production method of a dust core of the present invention will be described according to FIG. 1. At first, a ferromagnetic powder and an insulating material are mixed (S1 in FIG. 1). The insulating material contains an insulating resin and an inorganic insulating material. The ferromagnetic powder may be heated to eliminate strains before mixing. Further, the ferromagnetic powder may be subjected to oxidation treatment to form a thin oxide film in order to improve the insulating property among ferromagnetic powder particles. The mixing is carried out at a room temperature for 20 to 60 minutes using a pressurizing kneader, a stirrer and the like. After mixing drying is carried out at 100 to 300° C. for 20 to 60 minutes (S2 in FIG. 1).

After drying, the resultant mixture is pulverized (S3 in FIG. 1) and mixed with a lubricant to obtain a powder for dust cores (S4 in FIG. 1). In this case, as the lubricant, aluminum stearate or a mixture of aluminum stearate and other stearic acid metal salts is used. The mixing can be carried out using properly selected mixing apparatus from a container rotation type such as a V-type mixing apparatus and a container fixing type such as a rotary disk type. For example, in case of the V-type mixing apparatus, mixing may be carried out at 30 to 80 rpm rotation speed for 15 to 60 minutes.

Next, the resulting mixture is molded in a desired shape (S5 in FIG. 1). The shape of magnetic core is not specifically restricted and may be toroidal type, E type, drum type, pot type or another shape. Molding conditions are not specifically restricted and molding is carried out in pressure of 390 to 1960 MPa for 0.1 to 60 seconds as the retention time at the maximum pressure and the conditions may properly be determined corresponding to the type and the shape of the ferromagnetic powder, the shape and the size of an aiming magnetic core, the density of the magnetic core, and the like. Addition of aluminum stearate improves the lubricating property among ferromagnetic powder particles at the time of molding, so that, especially, the spring back degree can be suppressed at the time of taking the molded body out of the mold and further the strength of the molded body can be increased. Further, the separation property of the molded body at the time of taking the molded body out of the mold is improved, so that the molded body is prevented from being deformed owing to the adhesion of the molded body to the mold.

After the molding, in order to release the strains caused in the ferromagnetic powder by pressure application by the mold, heating treatment may be carried out (S6 in FIG. 1). In the case of the compacted powder magnetic core of the present invention containing aluminum stearate, the strains at the time of molding is small and heating treatment may not be carried out. Nevertheless, in the case of performing the heating treatment, the heating conditions may properly be determined corresponding to the type and the shape of the ferromagnetic powder, the molding conditions and the like, and it is preferable to carry out heating at 550 to 850° C. for 10 minutes to 2 hours in non-oxidative atmosphere such as nitrogen gas, argon gas.

After the molding, a conductive wire is wound around and the magnetic core is assembled and inserted into a case.

EXAMPLES

Magnetic characteristics of a dust core of the present invention and mechanical characteristics of the molded body were evaluated.

Example 1

In this example, comparison was done for compacted powder magnetic cores using silicone resin as the insulating resin and aluminum stearate as a lubricant.

Compacted powder magnetic cores of examples 1—1 to 1–3 and comparative examples 1—1 to 1–3 were produced as follows. Table 1 shows the addition amounts of lubricants for ferromagnetic powders for compacted powders using silicone resin in this example 1.

TABLE 1

| Example No. Comparative Example No. | Insulating resin | Lubricant (Amount of Al:wt %) | Amount of lubricant (vol %) |
|---|---|---|---|
| Example 1-1 | Silicone resin | St—Al (4) | 0.8 |
| Example 1-2 | Silicone resin | St—Al (5) | 0.8 |
| Example 1-3 | Silicone resin | St—Al (7) | 0.8 |
| Comparative Example 1-1 | Silicone resin | St—Al (3.4) | 0.8 |
| Comparative Example 1-2 | Silicone resin | St—Zn (10) | 0.8 |
| Comparative Example 1-3 | Silicone resin | St (0) | 0.8 |

The insulating resin used was all silicone resin (trade name: SR2414, produced by Dow Corning Silicone Corp.). The ferromagnetic powder used was all Permalloy powder (trade name: DAPPB, produced by Daido Steel Co., Ltd.) and had the average particle diameter of 13 $\mu$m. Both were weighed and mixed and further mixed by a pressurizing kneader at a room temperature for 30 minutes. Then, the mixture was dried at 150° C. for 30 minutes in atmospheric air to obtain ferromagnetic powders for compacted powders.

The ferromagnetic powders for compacted powders were mixed with 0.8% by weight of lubricants and mixed by a V-type mixing apparatus for 15 minutes. As shown in Table 1, the metal (aluminum) contents of aluminum stearates were 4% by weight (trade name: SA-1500, produced by Sakai Chemical Industry Co., Ltd.), 5% by weight (trade name: SA-1000, produced by Sakai Chemical Industry Co., Ltd.), 7% by weight (first grade reagent, produced by Junsei Chemical Co., Ltd.), 3.4% by weight (trade name: SA-2000, produced by Sakai Chemical Industry Co., Ltd.), respectively, for the examples 1—1 to 1–3 and the comparative example 1. In the comparative example 1–2, zinc stearate used had a metal (zinc) content of 10% by weight (first grade reagent, produced by Kanto Chemical Co., Inc.) and in the comparative example 1–3, metal-free stearic acid (First grade reagent, produced by Sakai Chemical Industry Co., Ltd.) was used.

After the lubricants were added and mixed, the resultant powder mixtures were molded into toroidal shape of the external shape of 17.5 mm, the inner diameter of 10.2 mm, and the height of 5.0 mm in pressure of 490 MPa.

After the molding, the magnetic characteristics and mechanical characteristics were measured. As the magnetic characteristics, the magnetic permeability $\mu_{eff}$ at 6000 A/m and 100 kHz was measured using an LCR meter (HP4284H, manufactured by Yokohama Huewlette Packerd Co., Ltd.). Further, as core loss, the hysteresis loss (Ph), the eddy-current loss (Pe), and core loss (Pc) at 100 kHz, 100 mT were measured by a B-H analyzer (SY-8232, Iwasaki Communication Co., Ltd.).

As mechanical characteristics, the spring back degree was computed by measuring the mold diameter and the outer diameter of the toroidal-shape compacted powder magnetic cores. Further, the strength up to the breakdown of the toroidal-shape compacted powder magnetic core was measured by a disk-type digital load tester (manufactured by Aoki Engineering Co., Ltd.) to measure the radial crushing strength.

Table 2 shows the results of these measurements.

TABLE 2

| Example No. Comparative Example No. | Magnetic characteristics: Effective magnetic permability $\mu_{eff}$ | Core loss (kW/m$^3$) Pc | Ph | Pe | Mechanical characteristics: Spring back degree (%) | Radical crushing strength (MPa) |
|---|---|---|---|---|---|---|
| Example 1-1 | 31 | 385 | 263 | 122 | 0.32 | 7.2 |
| Example 1-2 | 31 | 378 | 250 | 128 | 0.29 | 7.5 |
| Example 1-3 | 32 | 380 | 251 | 129 | 0.27 | 8.1 |
| Comparative Example 1-1 | 30 | 398 | 269 | 129 | 0.41 | 5.9 |
| Comparative Example 1-2 | 29 | 439 | 290 | 149 | 0.45 | 4.2 |
| Comparative Example 1-3 | 28 | 452 | 299 | 153 | 0.52 | 3.8 |

As reflected in Table 2, regarding the magnetic characteristics, using aluminum stearate in the examples 1—1 to 1–3 and comparative example 1—1 was found effective to provide magnetic permeability as high as 30 or higher. Further, the core loss (Pc) was lowered to 400 kW/m$^3$ or lower. Especially, as shown in the examples 1—1 to 1–3, addition of aluminum stearate with 5% by weight or higher metal content was found effective to lower the core loss (Pc) to extremely low, 390 kW/m$^3$ or lower, as compared with that of the comparative example 1—1, whereas the core loss was high, 400 kW/m$^3$ or higher in the comparative examples 1–2 and 1–3 where no aluminum stearate was used. Further, the hysteresis loss (Ph) and the eddy-current loss (Pe) also showed the same tendency.

Regarding mechanical characteristics, the spring back degrees were 0.32% or lower in the examples 1—1 to 1–3, whereas they were 0.41% or higher in the comparative examples 1—1 to 1–3, Further, the radial crushing strength was 7.5 MPa or higher in the examples 1—1 to 1–3, whereas it was 5.9 MPa or lower in the comparative examples 1—1 to 1–3. That implies that aluminum stearate firmly bonds the ferromagnetic powder particles without giving strain to the ferromagnetic powder.

Example 2

In this example, compacted powder magnetic cores using phenol resin as the insulating resin and aluminum stearate as a lubricant and the like were compared.

The examples 2-1 to 2-3 and the comparative examples 2-1 to 2-3 were prepared as follows. Table 3 shows the addition amounts of the lubricant in the ferromagnetic powders for compacted powders using the phenol resin in the example 2.

TABLE 3

| Example No. Comparative Example No. | Insulating resin | Lubricant (Amount of Al:wt %) | Amount of lubricant (vol %) |
|---|---|---|---|
| Example 2-1 | Phenol resin | St—Al (4) | 0.8 |
| Example 2-2 | Phenol resin | St—Al (5) | 0.8 |
| Example 2-3 | Phenol resin | St—Al (7) | 0.8 |
| Comparative Example 2-1 | Phenol resin | St—Al (3.4) | 0.8 |
| Comparative Example 2-2 | Phenol resin | St—Zn (10) | 0.8 |
| Comparative Example 2-3 | Phenol resin | St (0) | 0.8 |

The insulating material resin used was all resol-type phenol resin (trade name: ELS-582, produced by Showa Highpolymer Co., Ltd.). The compacted powder magnetic cores were produced in the same manner as the example 1 except the insulating resin.

After molding, the magnetic characteristics and mechanical characteristics were evaluated in the same manner as the example 1.

Table 4 shows the results of these measurements.

TABLE 4

| | Magnetic characteristics | | | | Mechanical characteristics | |
|---|---|---|---|---|---|---|
| Example No. Comparative | Effective magnetic permability | Core loss (kW/m$^3$) | | | Spring back degree | Radical crushing strength |
| Example No. | $\mu_{eff}$ | Pc | Ph | Pe | (%) | (MPa) |
| Example 2-1 | 32 | 388 | 263 | 125 | 0.33 | 7.6 |
| Example 2-2 | 32 | 381 | 250 | 131 | 0.30 | 7.8 |
| Example 2-3 | 32 | 379 | 249 | 130 | 0.29 | 8.3 |
| Comparative Example 2-1 | 31 | 401 | 271 | 130 | 0.43 | 5.6 |
| Comparative Example 2-2 | 28 | 445 | 295 | 150 | 0.48 | 3.9 |
| Comparative Example 2-3 | 29 | 459 | 308 | 151 | 0.55 | 3.7 |

As reflected in Table 4, regarding the magnetic characteristics, using aluminum stearate in the examples 2-1 to 2–3 and comparative example 2-1 was found effective to provide magnetic permeability as high as 30 or higher. Further, the core loss (Pc) was lowered to 400 kW/m$^3$ or lower. Especially, as shown in the examples 2-1 to 2–3, addition of aluminum stearate with 5% by weight or higher metal content was found effective to lower the core loss (Pc) to extremely low, 390 kW/m$^3$ or lower, as compared with the core loss (PC) of 401 kW/m$^3$ of the comparative example 1–1, whereas the core loss (PC) was high, 400 kW/m$^3$ or higher in the comparative example 2-1 and 2-3 where no aluminum stearate was used. Further, the hysteresis loss (Ph) and the eddy-current loss (Pe) also showed the same tendency.

Regarding mechanical characteristics, the spring back degrees were 0.33% or lower in the examples 2-1 to 2–3, whereas they were 0.43% or higher in the comparative examples 2-1 to 2–3. Further, the radial crushing strength was 7.6 MPa or higher in the examples 2-1 to 2–3, whereas it was 5.6 MPa or lower in the comparative examples 2-1 to 2–3. That implies that aluminum stearate firmly bonds the ferromagnetic powder particles without giving strain to the ferromagnetic powder. Further from Table 2 and Table 4, aluminum stearate was found to improve magnetic characteristics and mechanical characteristics even where the insulating resin is changed.

Figure 4:
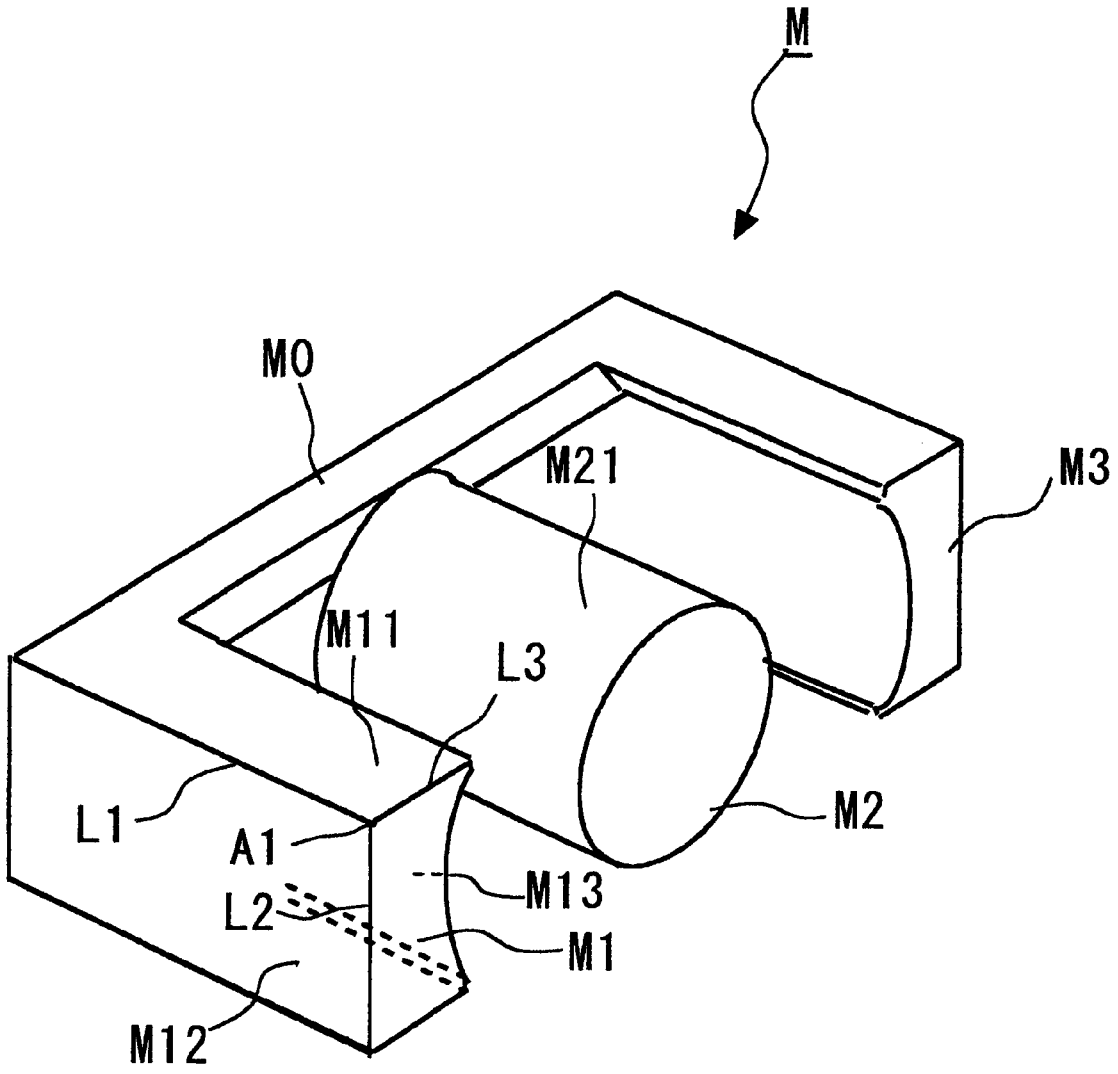
FIG. 4 is perspective view showing the structure of an ECC type dust core according to one embodiment of the present invention.

Next, a dust core, which is one embodiment of the present invention, will be described below. FIG. 4 is perspective view showing the structure of an ECC type compacted powder magnetic core, which is one embodiment of the present invention. The compacted powder magnetic core M is integrally formed as a magnetic core with an ECC type plan view comprising a main magnetic path M0 extended back and forth, three branch magnetic paths M1, M2, M3 branched to sides from the main magnetic path M0. The respective branch magnetic paths M1, M3 have approximately hexahedron shape and are joined to the main magnetic path M0 along one face side. Among the remaining outer faces, for example, an upper face M11, a rear face M12 and a right side face M13 of the branch magnetic path M1 define ridge lines L1, L2, L3 at their neighboring portions and these crossing ridge lines provides a vertical angle A1. Further, the branch magnetic path M2 is approximately cylindrical and the outer face M21 defines a curved face.

The inside of the ECC type compacted powder magnetic core M0 contains a ferromagnetic powder coated with an insulating resin and aluminum stearate. The aluminum stearate is cleaved and extended to form a film on the insulating resin coating and thus the ferromagnetic powder is inhibited from excessive slippage and aligned and the aluminum stearate stagnates in the gaps between the ferromagnetic powder particles to prevent the strains from remaining in the ferromagnetic powder. Especially, the ferromagnetic powder particles are aligned in the ridge line L1 or the curved face M21 of the ECC type compacted powder magnetic core and also strain generation is suppressed to lower the spring back degree. Further, partial defects owing to poor powdering can be prevented. Further, strain generation prevention is effective to prevent deterioration of magnetic permeability and suppress core loss of the compacted powder magnetic core.

As described above, the present invention provides a powder for dust cores which enables production of a dust core with excellent magnetic characteristics such as a high magnetic permeability, a low core loss and the like and excellent mechanical characteristics such as a low spring back degree independent of a high radial crushing strength.

Also, the present invention provides a dust core with excellent magnetic characteristics such as a high magnetic permeability, a low core loss, and the like and excellent mechanical characteristics such as a low spring back degree independent of a high radial crushing strength.

What is claimed is:

1. A magnetic powder for a dust core comprising:

a ferromagnetic powder;

an insulating material containing a silicone resin, a phenol resin, or a mixture thereof; and a lubricant, wherein the lubricant contains aluminum stearate, and the aluminum stearate comprises at least one compound selected from the group consisting of aluminum mono-stearate, aluminum di-stearate, and aluminum tri-stearate, and the aluminum stearate has an aluminum content of at least about 4% by weight, and not more than about 7.8% by weight based on the weight of aluminum stearate.

2. A magnetic powder for a dust core according to claim 1, wherein the aluminum stearate has a free fatty acid content of about 30% by weight or lower based on the weight of aluminum stearate.

3. A magnetic powder for a dust core according to claim 1, wherein the aluminum stearate is present in an amount in the range of about 0.2 to about 1.5% by weight based on the weight of the ferromagnetic powder.

4. A dust core obtained by the process of mixing a ferromagnetic powder, an insulating material containing a silicone resin, a phenol resin, or a mixture thereof, and a lubricant; and forming the mixture, wherein the combined content of the silicone resin and the phenol resin contained in the insulating material is in the range of about 1 to about 30% by volume based on the volume of the ferromagnetic powder; and the lubricant contains aluminum stearate, the aluminum stearate comprising at least one compound selected from the group consisting of aluminum mono-stearate, aluminum di-stearate, and aluminum tri-searate, and having an aluminum content of at least about 4% by weight and not more than about 7.8% by weight based on the weight of aluminum stearate.

5. A dust core according to claim 4, wherein the aluminum stearate has a free fatty acid content of about 30% by weight or lower, based on the weight of the aluminum stearate.

6. A dust core according to claim 4, wherein the aluminum stearate is present in an amount in the range of about 0.2 to about 1.5% by weight based on the weight of the ferromagnetic powder.

7. A magnetic powder for a dust core according to claim 2 wherein the aluminum stearate is present in an amount in the range of about 0.2 to about 1.5% by weight based on the weight of the ferromagnetic powder.

8. A dust core according to claim 5 wherein the aluminum stearate is present in an amount in the range of about 0.2 to about 1.5% by weight based on the weight of the ferromagnetic powder.

* * * * *

UNITED STATES PATENT AND TRADEMARK OFFICE

CERTIFICATE OF CORRECTION

PATENT NO. : 6,527,823 B2
DATED : March 4, 2003
INVENTOR(S) : Hideharu Moro

It is certified that error appears in the above-identified patent and that said Letters Patent is hereby corrected as shown below:

Column 6,
Line 29, delete "($Ti_2$))," and insert -- ($Ti_{02}$)), --.

Column 7,
Line 62, insert -- . -- after "lubricant".

Column 11,
Line 2, delete "," after "3" and insert -- . --.

Column 14,
Line 6, delete "tri-searate" and insert -- tri-stearate --.

Signed and Sealed this

Thirtieth Day of September, 2003

JAMES E. ROGAN
*Director of the United States Patent and Trademark Office*